US006345568B1

(12) United States Patent
Wakasugi et al.

(10) Patent No.: US 6,345,568 B1
(45) Date of Patent: Feb. 12, 2002

(54) FLUID PRESSURE DEVICE WITH REVERSIBLE MOUNTING MECHANISM

(75) Inventors: Mitsuharu Wakasugi; Tsukasa Kagiyama, both of Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/664,749

(22) Filed: Sep. 19, 2000

(30) Foreign Application Priority Data

Oct. 15, 1999 (JP) ..... 11-294581

(51) Int. Cl.[7] ..... F01B 1/00
(52) U.S. Cl. ..... 92/146
(58) Field of Search ..... 92/169.1, 165 PR, 92/5 R, 161, 146

(56) References Cited

U.S. PATENT DOCUMENTS 5,606,902 A * 3/1997 Hosono et al. ..... 92/88
5,884,549 A * 3/1999 Hosono et al. ..... 92/5 R
D444,795 S * 7/2001 Wakasugi et al. ..... D15/7

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

Mounting grooves 31*a* for a position sensor are respectively formed in a first face 20*a* and a second face 20*b* facing each other of a casing 20, a fixing hole 35*a* passing through the casing between the opposite faces is formed in a position which overlaps the mounting grooves 31*a*, a tubular washer member 37 having therein an annular flange 37*b* for forming a seat for a bolt is housed in the fixing hole 35*a* such that the washer member 37 can be moved to a first face 20*a* side and a second face 20*b* side, and the washer member 37 has such an axial length that the washer member 37 and the bolt head 36*a* do not interfere with the mounting groove 31*a* positioned in the face on the other side when the washer member has moved to any one of the opposite face sides.

6 Claims, 4 Drawing Sheets

FLUID PRESSURE DEVICE WITH REVERSIBLE MOUNTING MECHANISM

TECHNICAL FIELD

The present invention relates to a fluid pressure device having a reversible mounting mechanism by which the device can be mounted to a predetermined position on either one of two side faces facing each other through a bolt.

PRIOR ART

As one of fluid pressure devices, there is a dual-rod-type air cylinder, for example, in which two cylinder mechanisms 2*a* and 2*b* having pistons 2 and rods 3 are mounted in a casing 1 in a shape of a flat and short prism, the two rods 3, 3 projecting from the casing 1 are connected to a common plate 5, and a workpiece 6 is driven by the two rods 3, 3 through the plate 5 as shown in FIGS. 6 and 7. In this air cylinder, in order to detect operating positions of the pistons 2 to produce control signals for automatic operation, sensor mounting grooves 7 are formed in positions close to cylinder bores in the casing 1 and position sensors 8 are mounted in the mounting grooves 7. In order to fix the air cylinder to a predetermined position through bolts 9, fixing holes 10 are formed in the casing.

In such an air cylinder, there is no problem if the fixing holes 10 are formed in such positions as not to overlap the sensor mounting grooves 7. However, if the fixing hole 10 and the sensor mounting groove 7 are formed in such positions as to overlap one another as shown in FIGS., it is necessary to apply deep spot-facing processing 10*a* such that bolt head 9*a* is in a position lower than the sensor mounting groove 7 so as to prevent the bolt head 9*a* positioned on the sensor mounting groove 7 from obstructing mounting of the position sensor 8.

If the air cylinder needs to be able to be fixed on either one of left and right side faces, it is necessary to form the sensor mounting grooves 7 in the opposite side faces of the casing 1 and to apply the deep spot-facing processing 10*a* described above to each ends of the fixing hole 10 such that the bolt 9 can be inserted from either face to fix the air cylinder. However, in a case of a small air cylinder in which diameters of the pistons 2 and a thickness of the casing 1 are small, because a gap between the two sensor mounting grooves 7, 7 in the opposite side faces is small, it is impossible to apply deep spot-facing processing 10*a* to the opposite ends of the fixing hole 10.

DISCLOSURE OF THE INVENTION

It is a technical object of the present invention to provide a fluid pressure device having mounting grooves into which an accessory part such as a sensor is mounted and a fixing hole for fixing the device by a bolt, the mounting grooves and the fixing hole being formed in positions overlapping each other, wherein the fluid pressure device can be fixed by the bolt on either one of two side faces facing each other of the device by providing a reversible mounting mechanism with a simple structure without applying deep spot-facing processing for preventing interference with the accessory part to opposite ends of the fixing hole.

To achieve the above object, in a fluid pressure device of the present invention, a casing having mounting grooves for accessory parts respectively on a first face and a second face facing each other of the casing is formed with a fixing hole for fixing the fluid pressure device by a bolt such that the fixing hole passes through the casing between the opposite faces in a position which overlaps the mounting grooves, a washer member for forming a seat with which a bolt head is brought into contact is housed in the fixing hole such that the washer member can be moved to a first face side and a second face side, and the washer member has such an axial length that the washer member and the bolt head do not interfere with the mounting groove cut in the face on the other side when the washer member has moved to any one of the opposite face sides.

In the fluid pressure device having the above structure, when the second face of the casing is brought into contact with a portion to which the device is mounted and the bolt is inserted into the washer member in the fixing hole from the first face side to fix the fluid pressure device, the washer member is moved to the second face side and the device is fixed by the bolt in this state. At this time, because both the washer member and the bolt head are in lower positions than the mounting groove in the first face side and do not interfere with the mounting groove, the accessory part such as the position sensor can be mounted into the mounting groove without hindrance.

On the other hand, when the first face of the casing is brought into contact with a portion to which the device is mounted and the bolt is inserted into the fixing hole from the second face side to fix the fluid pressure device, the washer member is moved to the first face side. At this time, because both the washer member and the bolt head do not interfere with the mounting groove on the second face side, the accessory part such as the position sensor can be mounted into the mounting groove without hindrance.

Thus, according to the invention, it is possible to reversibly mount even the small fluid pressure device with a small thickness to a predetermined position on either one of the two side faces facing each other of the device by a remarkably simple structure in which the annular washer member is housed for movement in the fixing hole without applying deep spot-facing processing for preventing interference with the accessory part to the opposite ends of the fixing hole.

According to a concrete embodiment of the invention, the washer member has an annular and inward flange forming the seat in a tube portion.

According to a preferred embodiment of the invention, an inner peripheral face of the fixing hole and an outer peripheral face of the washer member are respectively threaded and the washer member is screwed into the fixing hole such that a position of the washer member can be adjusted by rotation.

According to another concrete embodiment of the invention, the fluid pressure device is a dual-rod-type air cylinder and has two cylinder bores formed in parallel to each other in the casing, pistons which can slide in the respective cylinder bores, and rods extending from the respective pistons. The mounting grooves are the mounting grooves into which the position sensor for detecting an operating position of the piston is mounted and are formed along one of the two cylinder bores in positions facing each other at central portions on the opposite faces of the casing.

DETAILED DESCRIPTION

Figure 1:
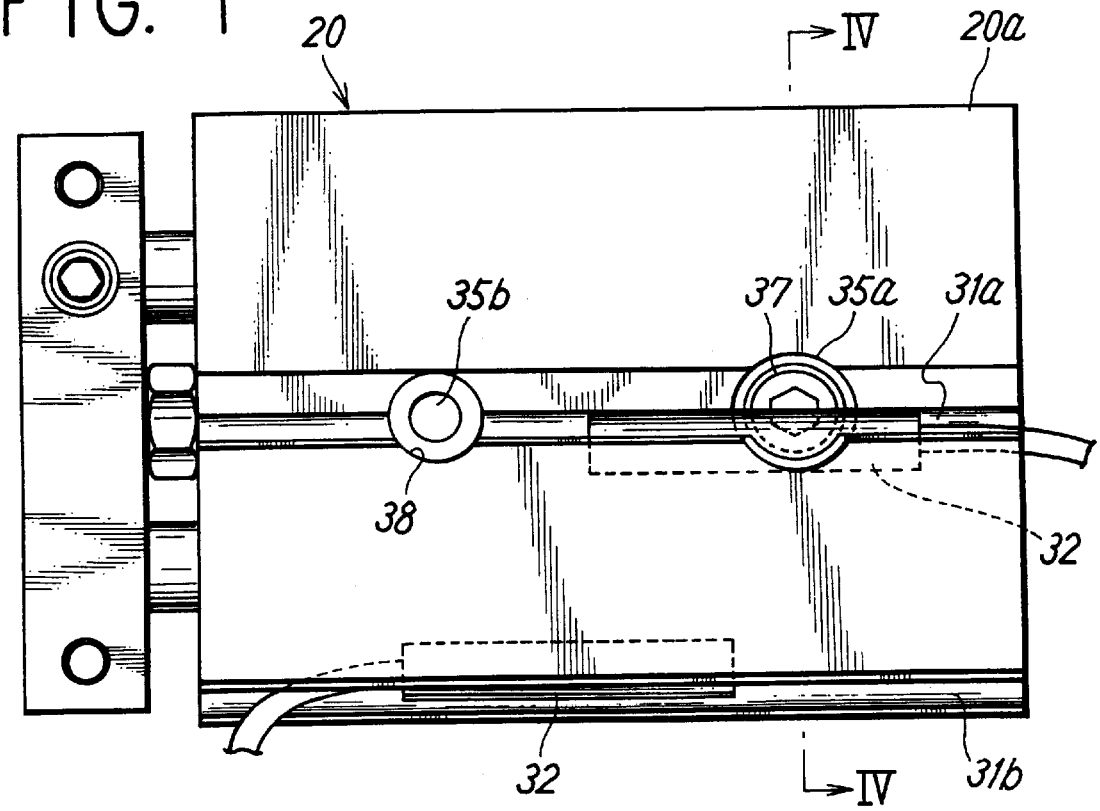
FIG. 1 is a plan view showing an embodiment of a fluid pressure device according to the present invention.
Figure 2:
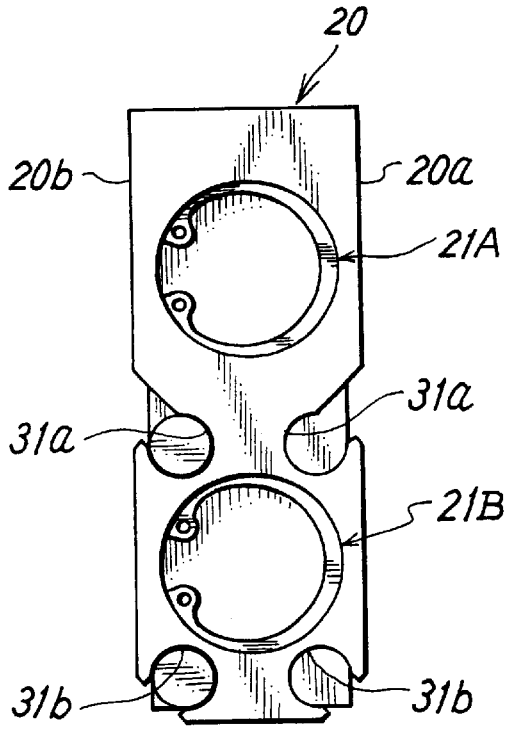
FIG. 2 is a side view of FIG. 1.
Figure 3:
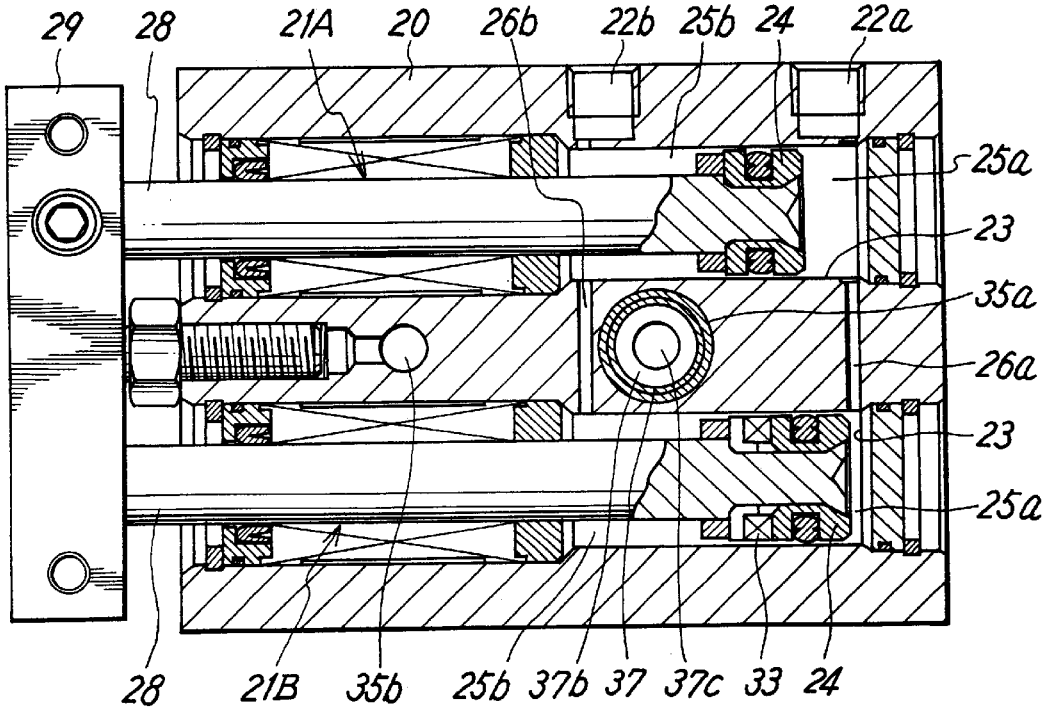
FIG. 3 is an enlarged cross-sectional plan view of FIG. 1.

Preferred embodiments of the present invention will be described in detail by reference to the drawings. FIGS. 1 to 4 show a dual-rod-type air cylinder as an example of a fluid pressure device. The air cylinder has a casing 20 with a sectional shape of a flat and short prism. Two cylinder mechanisms 21A and 21B are mounted in parallel to each other in the casing 20 and the cylinder mechanisms 21A and 21B are synchronously actuated by compressed air supplied from a pair of common ports 22*a* and 22*b*.

In other words, two cylinder bores 23, 23 are formed in parallel to each other in the casing 20 and a piston 24 is housed for sliding in each the cylinder bore 23. Two pressure chambers 25*a* and 25*b* are formed on opposite sides of each the piston 24. The pressure chambers 25*a* and 25*a* and the chambers 25*b* and 25*b* corresponding to each other of the two cylinder mechanisms 21A and 21B communicate with each other by a through hole 26*a* or 26*b* provided to a partition between the two cylinder bores 23, 23 and communicate with the ports 22*a* and 22*b* formed in a side face of the casing 20. By the compressed air supplied from the ports, the two pistons 24, 24 are synchronously actuated.

A rod 28 is connected to each the piston 24 and a tip end of each the rod 28 extends from the cylinder bore 23 and is connected to a common plate 29 so as to drive a workpiece through the plate 29.

In positions close to a center of the casing 20 and positions close to a side end portion of the casing 20 on first and second respective faces 20*a* and 20*b* facing each other of the casing 20, two mounting grooves 31*a* and two mounting grooves 31*b* into which position sensors 32 are mounted are formed respectively. The position sensors 32 are magnetometric sensors for detecting a magnet 33 provided to the piston 24. The magnet 33 is provided to only one piston 24 of the cylinder mechanism 21B. Therefore, the mounting grooves 31*a* and 31*b* are provided on opposite sides of the cylinder bore 23 of the cylinder mechanism 21B such that the mounting grooves 31*a* and 31*b* are close to the cylinder bore 23. In the one mounting groove 31*a*, the position sensor 32 is mounted in such a position as to detect one stroke end of the piston 24. In the other mounting groove 31*b*, another position sensor 32 is mounted in such a position as to detect the other stroke end of the piston 24.

Furthermore, at a central portion of the casing 20 between the two cylinder bores 23, two fixing holes 35*a* and 35*b* passing from the first face 20*a* to the second face 20*b* are formed in such positions as to overlap the mounting grooves 31*a* close to the center. In the fixing hole 35*a* in such a position as to interfere with the position sensor 32, a washer member 37 for forming a seat used in fixing through a bolt 36 is housed for movement between a position close to the first face 20*a* side and a position close to the second face 20*b* side.

Figure 4:
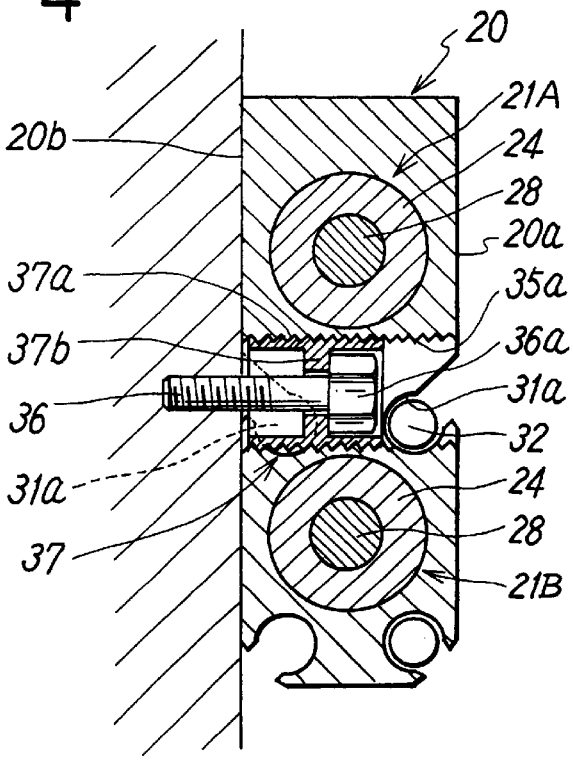
FIG. 4 is an enlarged sectional view taken along a line A—A in FIG. 1 and shows an example of mounting.

As can be seen from FIG. 4, the washer member 37 has an annular and inward flange 37*b* forming the seat at a center of an inside of a tube portion 37*a* in a cylindrical shape. An outer peripheral face of the tube portion 37*a* is threaded and the washer member 37 is housed in the fixing hole 35*a* by fitting the thread on the outer peripheral face of the tube portion 37*a* with a thread formed on an inner peripheral face of the fixing hole 35*a* by screwing such that a position of the washer member 37 can be adjusted by rotating of the member 37. An axial length of the washer member 37 is set at such a value that the washer member 37 and a head 36*a* of the bolt 36 do not interfere with a mounting groove 31*a* on the first face 20*a* side when the washer member 37 is moved to the second face 20*b* side and fixed by the bolt 36 (see FIG. 4) and that the washer member 37 and the head 36*a* of the bolt 36 do not interfere with the mounting groove 31*a* on the second face 20*b* side when the washer member 37 is moved to the first face 20*a* side and fixed by the bolt 36 (see FIG. 5).

By forming a central hole 37*c* of the flange 37*b* into a hexagon, the washer member 37 can be rotated easily by inserting a tool such as a hexagonal wrench into the central hole 37*c*.

Because the other fixing hole 35*b* is in such a position as not to interfere with the position sensor 32, the other fixing hole 35*b* does not need the above structure unlike the fixing hole 35*a*. Therefore, in the present embodiment, spot facings 38 with such depths that the bolt head 36*a* can be fitted into the spot facings 38 are merely provided to opposite ends of the fixing hole 35*b*. However, it is of course possible that the fixing hole 35*b* has the structure similar to that of the fixing hole 35*a*.

In the air cylinder having the above structure, as shown in FIG. 4, in order to bring the second face 20*b* of the casing 20 into contact with a position to which the air cylinder is to be mounted and to insert the bolt 36 into the washer member 37 in the fixing hole 35*a* from the first face 20*a* side to fix the air cylinder, the washer member 37 is rotated and moved to the second face 20*b* side in the fixing hole 35*a*. In this state, the bolt 36 is inserted through the annular flange 37*b* and tightened. At this time, because both of the washer member 37 and the head 36*a* of the bolt 36 are in the positions lower than the mounting groove 31*a* on the first face 20*a* side and do not interfere with the mounting groove 31*a*, an accessory part such as the position sensor 32 can be mounted into the mounting groove 31*a* without hindrance.

Into the other fixing hole 35*b* merely applied with the spot-facing processing, the bolt 36 is mounted with the head 36*a* projecting into the mounting groove 31*a*.

Figure 5:
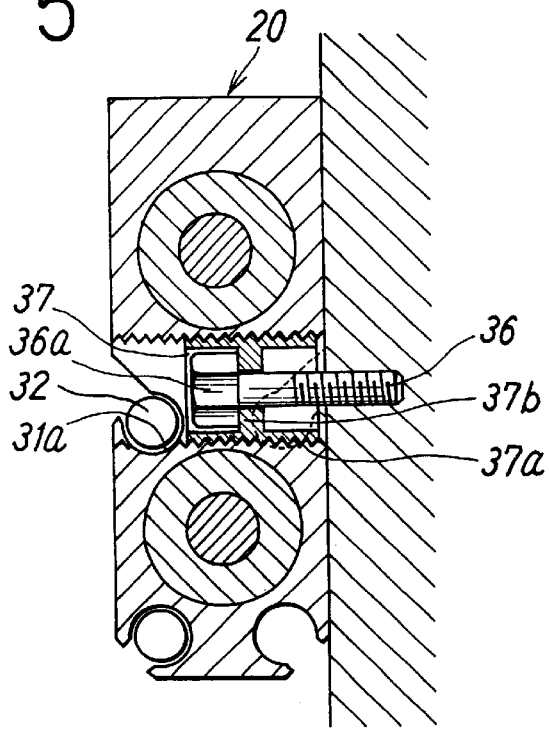
FIG. 5 is a sectional view in a similar position to FIG. 4 but showing another example of mounting.
Figure 6:
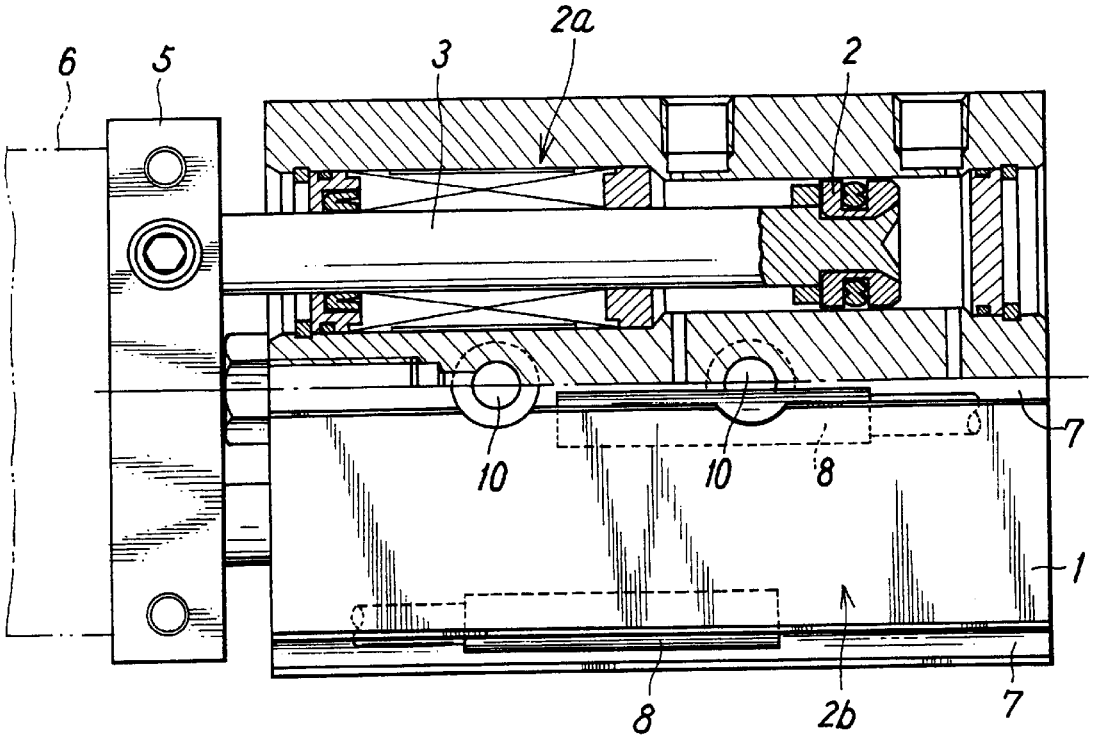
FIG. 6 is a plan view of prior art.
Figure 7:
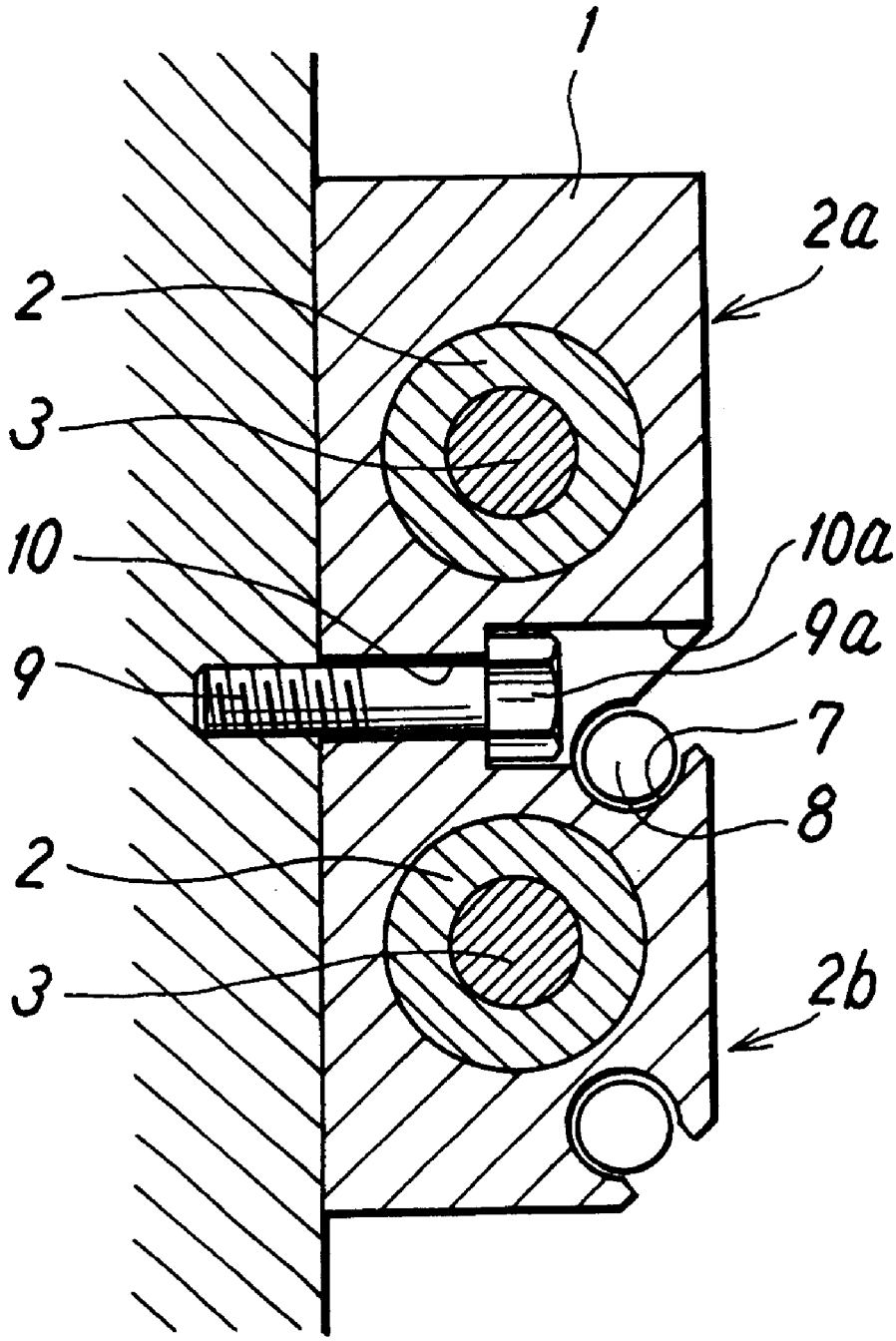
FIG. 7 is a sectional view of FIG. 6.

As shown in FIG. 5, in order to bring the first face 20*a* of the casing 20 into contact with a position to which the air cylinder is to be mounted and to insert the bolt 36 into the washer member 37 in the fixing hole 35*a* from the second face 20*b* side to fix the air cylinder, the washer member 37 is moved to the first face 20*a* side. Thus, because the washer member 37 and the bolt head 36*a* do not interfere with the mounting groove 31*a* on the second face 20*b* side, the accessory part such as the position sensor can be mounted into the mounting groove 31*a* without hindrance.

Thus, by a remarkably simple structure in which the annular washer member 37 is housed for movement in the fixing hole 35*a*, it is possible to reversibly mount the fluid pressure device such as the air cylinder to the predetermined position on any side of the device without applying deep spot-facing processing to the opposite ends of the fixing hole 35*a* so as to prevent interference with the sensor mounting groove 31*a*. As a result, even in a case of a small fluid pressure device with such a small thickness that the spot-facing processing cannot be applied to the opposite faces, the device can be mounted reversibly on opposite faces of the device by incorporating the above-described mounting mechanism.

Although the washer member 37 has the annular flange 37*b* in the substantially central position of the inside of the tube portion 37*a* and the head 36*a* of the bolt 36 can be housed in each of portions on the opposite sides of the annular flange 37*b* in the tube portion 37*a* in the above embodiment, the flange 37*b* may be displaced toward either end side of the tube portion 37*a*. It is also possible to form the washer member 37 as a simple annular member without the tube portion 37*a*.

The washer member 37 may be mounted for movement by sliding unlike the above embodiment in which the washer member 37 is screwed into the fixing hole 35*a* such that the position of the washer member 37 can be adjusted. In this case, it is necessary to form projections and the like at opposite end portions of the fixing hole 35*a* such that the washer member 37 is locked to the casing 20 respectively at the end portion on the first face 20*a* side and the end portion on the second face 20*b* side.

As described above, according to the present invention, by employing the remarkably simple structure in which the annular washer member is housed for movement in the fixing hole, it is possible to reversibly mount the fluid pressure device such as the air cylinder to the predetermined position without applying the deep spot-facing processing to the opposite ends of the fixing hole so as to prevent interference with the sensor mounting groove. Especially, even in the case of the small fluid pressure device with such a small thickness that the spot-facing processing cannot be applied to the opposite faces, the device can be mounted reversibly on opposite faces of the device by incorporating the above-described mounting mechanism.

What is claimed is:

1. A fluid pressure device comprising a casing having grooves for mounting accessory parts respectively in positions corresponding to each other on a first face and a second face oppositely facing each other on said casing, said casing is with a fixing hole for fixing said fluid pressure device by a bolt such that said fixing hole passes through said casing between said opposite faces in a position which overlaps said mounting grooves, a washer member for forming a seat with which a bolt head is brought into contact is housed in said fixing hole such that said washer member is movable to a first face side and a second face side, and said washer member has such an axial length that said washer member and said bolt head do not interfere with said mounting groove cut in said face on the other side in a state in which said washer member has moved to any one of said first face side and said second face side.

2. A fluid pressure device according to claim 1, wherein said washer member has an annular and inward flange forming said seat in a tube portion.

3. A fluid pressure device according to claim 1, wherein an inner peripheral face of said fixing hole and an outer peripheral face of said washer member are respectively threaded and said washer member is screwed into said fixing hole such that a position of said washer member is adjusted by rotation.

4. A fluid pressure device according to claim 2, wherein an inner peripheral face of said fixing hole and an outer peripheral face of said washer member are respectively threaded and said washer member is screwed into said fixing hole such that a position of said washer member can be adjusted by rotation.

5. A fluid pressure device according to claim 4, wherein a bolt insertion hole at a center of said flange in said washer member is formed into a hexagon such that a tool for rotating said washer member can be locked to said bolt insertion hole.

6. A fluid pressure device according to claim 1, wherein said fluid pressure device has two cylinder bores formed in parallel to each other in said casing, pistons which slide in said respective cylinder bores, and rods extending from said respective pistons, and said mounting grooves on outer faces of said casing are mounting grooves into each of which a position sensor for detecting an operating position of said piston is mounted and are formed in positions facing each other at central portions on said first face and said second face of said casing such that said mounting grooves are close to one of said two cylinder bores.

* * * * *